US009115514B2

(12) United States Patent
Papanikolaou et al.

(10) Patent No.: US 9,115,514 B2
(45) Date of Patent: Aug. 25, 2015

(54) MECHANICALLY INITIATED SPEED-BASED LATCH DEVICE

(71) Applicant: Ford Global Technologies, LLC, Dearborn, MI (US)

(72) Inventors: Kosta Papanikolaou, Hungtington Woods, MI (US); Rajesh K. Patel, Farmington Hills, MI (US); David Manuel Rogers, Southfield, MI (US); Livianu Dorin Puscas, Rochester Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/644,520

(22) Filed: Oct. 4, 2012

(65) Prior Publication Data

US 2014/0097624 A1 Apr. 10, 2014

(51) Int. Cl.
*E05B 3/00* (2006.01)
*E05B 77/06* (2014.01)

(52) U.S. Cl.
CPC ..... *E05B 77/06* (2013.01); *Y10T 292/1043* (2015.04); *Y10T 292/1047* (2015.04); *Y10T 292/1083* (2015.04); *Y10T 292/18* (2015.04); *Y10T 292/57* (2015.04)

(58) Field of Classification Search
CPC ..... E05C 19/00; E05C 3/14
USPC ..... 292/DIG. 22, 216, 194, 230, 198, 203
See application file for complete search history.

(56) References Cited

U.S. PATENT DOCUMENTS

| | | | | |
|---|---|---|---|---|
| 3,990,531 | A | 11/1976 | Register | |
| 5,669,642 | A | 9/1997 | Kang | |
| 6,007,122 | A | 12/1999 | Linder et al. | |
| 6,042,159 | A | 3/2000 | Spitzley et al. | |
| 6,241,294 | B1 | 6/2001 | Young et al. | |
| 6,971,688 | B2 | 12/2005 | Drysdale et al. | |
| 7,070,212 | B2 | 7/2006 | Spurr | |
| 7,481,468 | B2 | 1/2009 | Merideth et al. | |
| 7,635,151 | B2 | 12/2009 | Rodawold, Jr. et al. | |
| 7,686,355 | B2 | 3/2010 | Jankowski et al. | |
| 8,029,032 | B1 | 10/2011 | Yang | |
| 8,152,209 | B2 * | 4/2012 | Lee | 292/336.3 |
| 8,303,004 | B2 | 11/2012 | Lee et al. | |
| 8,322,077 | B2 | 12/2012 | Papanikolaou et al. | |
| 8,366,159 | B2 | 2/2013 | Patel | |
| 8,701,817 | B2 | 4/2014 | Schoen | |
| 8,814,232 | B2 | 8/2014 | Bertolotti | |
| 2005/0184537 | A1 | 8/2005 | Le et al. | |

(Continued)

FOREIGN PATENT DOCUMENTS

WO 2013093092 A1 6/2013

*Primary Examiner* — Kristina Fulton
*Assistant Examiner* — Thomas Neubauer
(74) *Attorney, Agent, or Firm* — Raymond Coppiellie; Price Heneveld LLP

(57) ABSTRACT

A pawl actuation device includes a movable input member that shifts from a first position to an actuated position. The pawl actuation device also includes linkage that selectively interconnects the movable input member and the pawl such that movement of the movable input member at a first velocity causes the pawl to shift to an unlatched position, and movement of the movable input member at a second velocity that is substantially greater than the first velocity does not cause the pawl to shift to its unlatched position, such that pawl remains in its latched position.

10 Claims, 6 Drawing Sheets

(56) References Cited

U.S. PATENT DOCUMENTS

| | | | |
|---|---|---|---|
| 2009/0223263 | A1 | 9/2009 | Puscas et al. |
| 2010/0320777 | A1 | 12/2010 | Jankowski et al. |
| 2013/0056999 | A1 | 3/2013 | Beck |
| 2014/0015263 | A1 | 1/2014 | Da Deppo et al. |
| 2014/0097624 | A1 | 4/2014 | Papanikolaou et al. |
| 2014/0132008 | A1 | 5/2014 | Bendel et al. |
| 2014/0145454 | A1 | 5/2014 | Da Deppo et al. |

* cited by examiner

MECHANICALLY INITIATED SPEED-BASED LATCH DEVICE

FIELD OF THE INVENTION

The present invention generally relates to a door latch system for motor vehicles, and specifically to a door latch that does not release unless the handle is pulled open slowly.

BACKGROUND OF THE INVENTION

Various types of vehicle door latches and handles have been developed. The latch and handle assembly may include a handle that can be pulled outwardly by a user to release a door latch, thereby permitting the door to open. However, if a vehicle is subject to a lateral acceleration, the acceleration may cause the handle to shift outwardly due to its own mass, thereby causing the latch to release. Various counterweights and inertia locks have been developed to prevent inadvertent unlatching of a door latch during lateral acceleration of the vehicle.

With reference to FIGS. 1 and 2, a prior art latch release mechanism 5 includes an outside release lever 6 having an end 8 that is operably connected to an outside door handle (not shown) of a motor vehicle. An intermediate link 10 is pivotably connected to outside release lever 6 at a pin or pivot 12, such that rotation of outside release lever 6 from a rest position to an actuated position causes link 10 to shift longitudinally as indicated by the arrow "A." End 14 of link 10 includes a step or notch 16 having a push surface 18 that is configured to engage a surface 20 of a pawl lifter 22. Pawl lifter 22 is rotatably connected to a door structure by a rotatable connector 24 which may comprise a boss, pin, shaft, or the like for movement. Link 10 is rotatably biased into engagement with pawl lifter 22 by a torsion spring (not shown) at pivot 12. The torsion spring biases link 10 in a counter clockwise direction (FIGS. 1 and 2), such that longitudinally extending surface 26 of link 10 slidably engages end surface 28 of pawl lifter 22 as link 10 moves in the direction of the arrow "A." Thus, in operation, surface 26 of link 10 always remains engaged with the end surface 28 of pawl lifter 22, regardless of the position and velocity of link 10. If an exterior force tending to rotate outside release lever 6 in the direction of the arrow A1 is applied to an outside door handle, link 10 shifts longitudinally in the direction of the arrow A with surfaces 26 and 28 slidably engaging each other initially. Surfaces 18 and 20 come into contact and abuttingly engage one another to thereby rotate pawl lifter 22 in the direction of the arrow "A2" from its unlatched position to its latched position. Thus, in operation, movement of outside release lever 6 from its rest position to its actuated position always causes surface 18 of link 10 to contact surface 20 of pawl lifter 22 and always unlatches the vehicle door latch, regardless of the velocity at which outside release lever 6 is moved from its rest position to its actuated position. The pawl (not shown) is directly connected to pawl lifter 22, such that rotation of pawl lifter 22 from its unlocked position to its locked position causes the pawl to shift from the latched position to the unlatched position, thereby unlatching the vehicle door latch.

SUMMARY OF THE INVENTION

One aspect of the present invention is a vehicle door including a device for controlling actuation of a pawl of a vehicle door latch mechanism based on a rate of movement of an exterior vehicle door handle. The vehicle door includes a door structure, and an outside door handle movably mounted to the door structure. The door also includes an outside release member that is movably mounted to the door structure. The outside release member is operably connected to the outside door handle such that movement of the outside door handle causes movement of the outside release lever from a first position to an actuated position. The vehicle door further includes a latch mechanism mounted to the door structure. The latch mechanism includes a movable latch member and a movable pawl. The movable pawl selectively retains the latch member in a latched position when the pawl is in a latched position, and permits movement of the latch when the pawl is in a unlatched position. The vehicle door still further includes an intermediate link that selectively interconnects the outside release member to the pawl lifter when the intermediate link is in an engaged configuration. The intermediate link is biased from a first disengaged configuration towards the engaged configuration. The intermediate link further defines a second disengaged position, and the intermediate link includes a first pawl-engaging surface. The movable pawl has a first link-engaging surface that engages the first pawl-engaging surface of the intermediate link when the intermediate link is in the engaged configuration to thereby cause movement of the pawl from its latched position to its unlatched position upon movement of the outside release member from its first position to its actuated position. The intermediate link includes a second pawl-engaging surface and the movable pawl has a second link-engaging surface that selectively engages a second pawl-engaging surface to retain the link in a disengaged configuration when the outside release member is in the first position. Shifting of the outside release member from the first position to the actuated position at a first velocity causes the link to shift to engaged configuration and engage the pawl and move the pawl from its latched position to its unlatched position. Shifting of the outside release member from the first position to the actuated position at a second velocity causes the link to shift from its first disengaged position to its second disengaged position without moving the pawl to its unlatched position if the second velocity is significantly greater than the first velocity.

Another aspect of the present invention is a pawl actuation device including a pawl selectively locking a door latch in an engaged position when the pawl is in a latched position. The device further includes a movable input member that shifts from a first position to an actuated position. The pawl actuation device also includes linkage that selectively interconnects the movable input member and the pawl such that movement of the movable input member at a first velocity causes the pawl to shift to an latched position, and movement of the movable input member at a second velocity that is substantially greater than the first velocity does not cause the pawl to shift to its unlatched position such that pawl remains in its latched position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
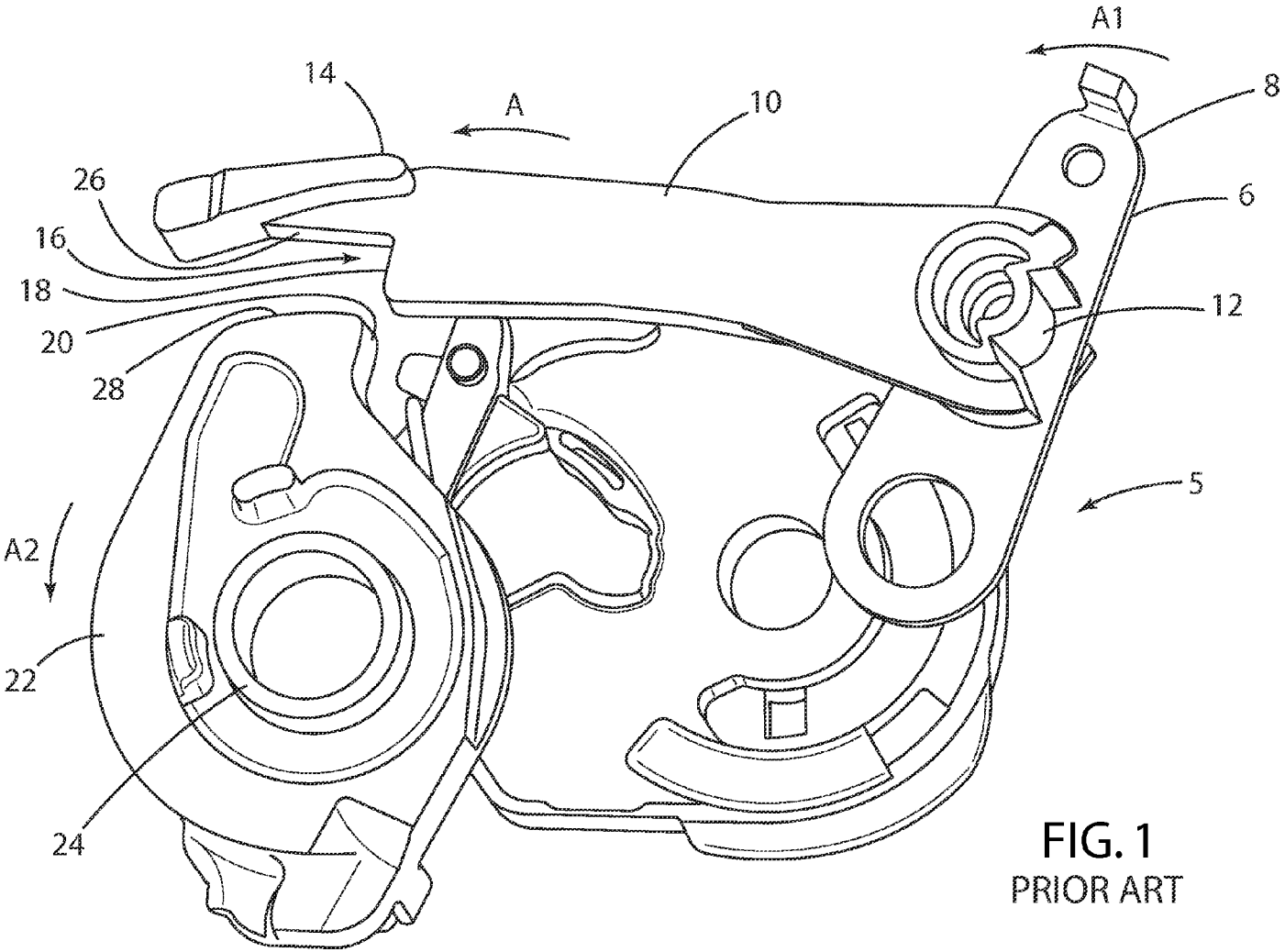
FIG. 1 PRIOR ART
FIG. 1 is an isometric view of a prior art door latch release assembly.
Figure 2:
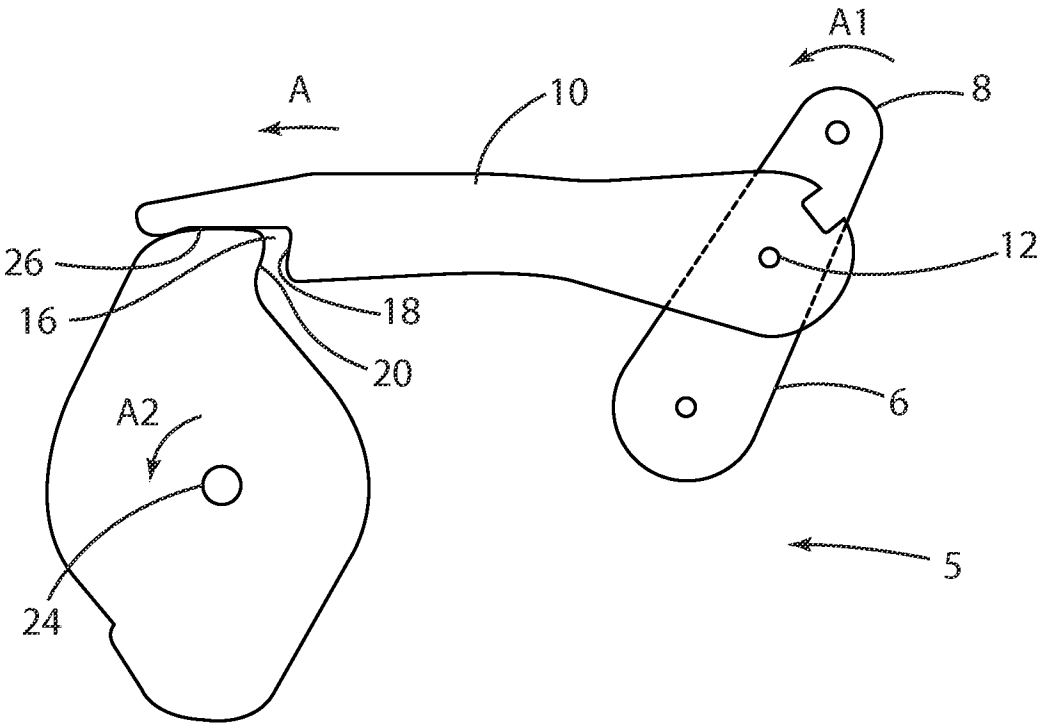
FIG. 2 PRIOR ART
FIG. 2 is a schematic view of the prior art door latch release assembly of FIG. 1.
Figure 3:
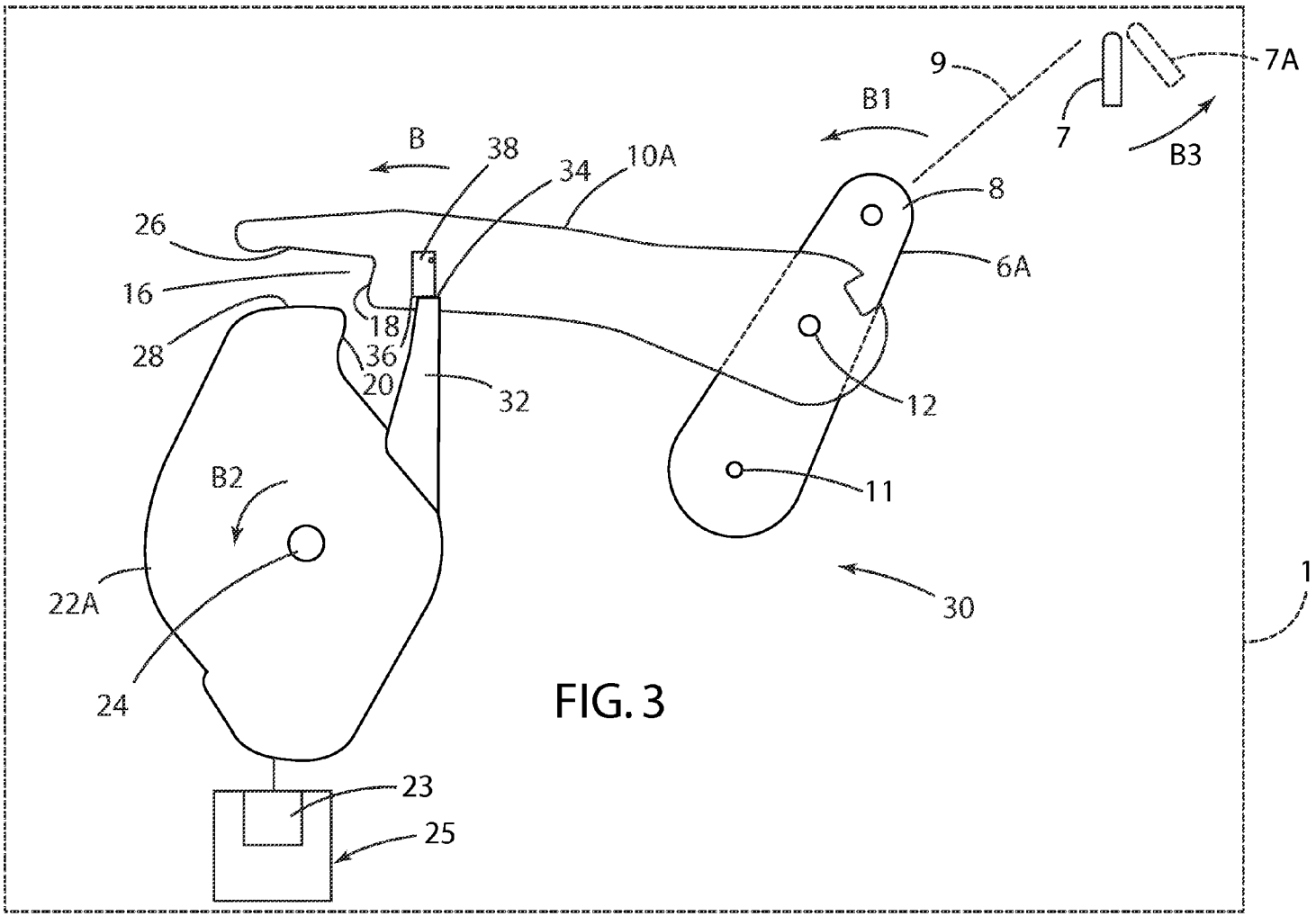
FIG. 3 is a partially schematic view of a latch device according to one aspect of the present invention wherein the door handle is in a closed position.

For purposes of description herein, the terms "upper," "lower," "right," "left," "rear," "front," "vertical," "horizontal," and derivatives thereof shall relate to the invention as oriented in FIG. 3. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
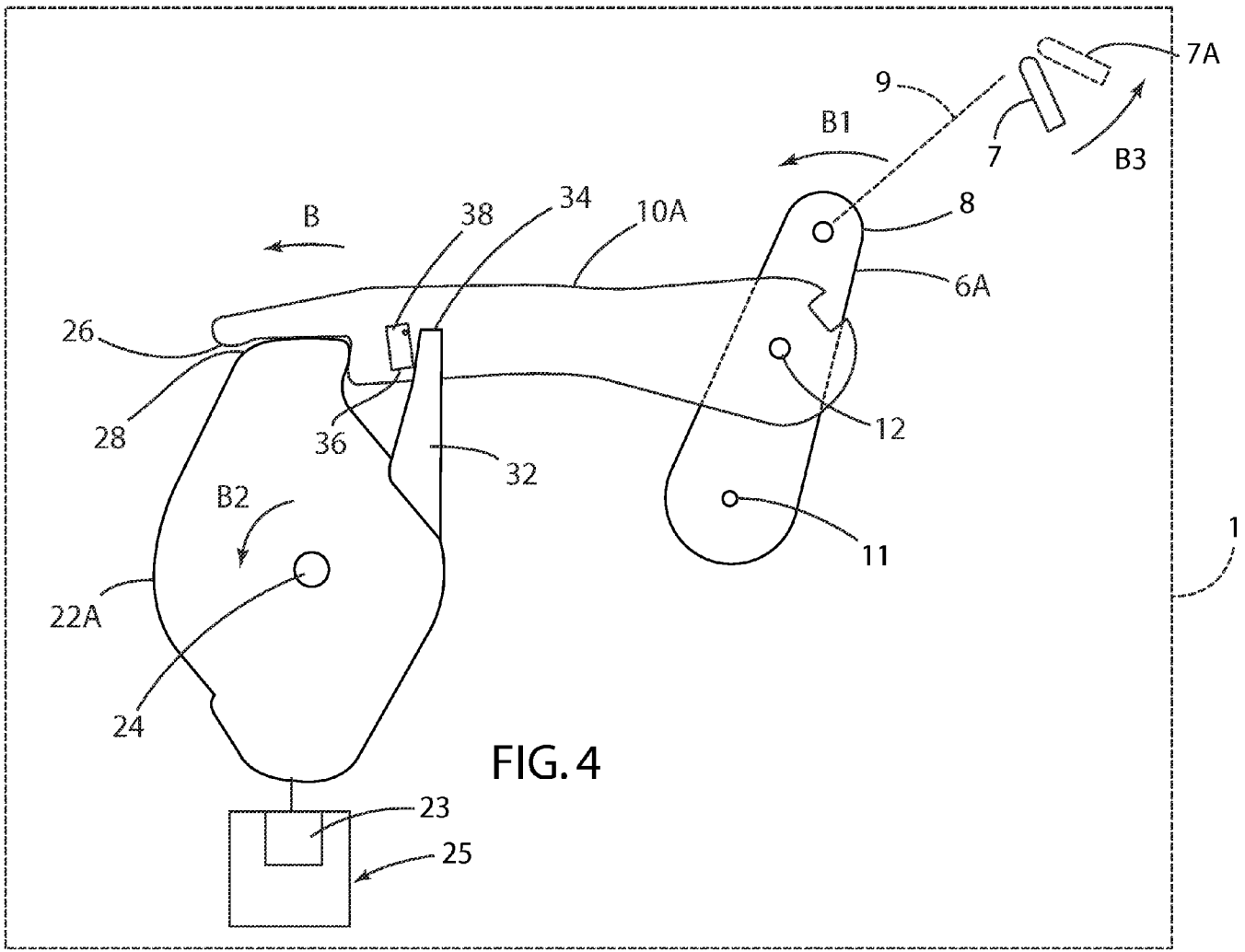
FIG. 4 is a partially schematic view of a latch device according to one aspect of the present invention wherein the linkage is engaged as a result of a relatively slow outward pull of the handle.

With reference to FIG. 3, a latch mechanism 30 according to one aspect of the present invention includes an outside release member such as release lever 6A that is operably connected to an outside door handle 7 by a known linkage 9. Movement of handle 7 causes outside release lever 6A to rotate about pin or pivot 11. Latch mechanism 30 also includes a link 10A, and a pawl lifter 22A that is operably connected to a pawl 23 of a conventional latch mechanism 25. Outside release lever 6A is rotatably connected to a door structure 1 by pin or pivot 11. Link 10A includes a step 16 defined by transverse surfaces 18 and 26. Pawl lifter 22A includes surfaces 20 and 28 that engage surfaces 18 and 26, respectively, of link 10A. Pawl lifter 22A includes a prong or extension 32 having an end surface 34. (See also FIG. 4). Link 10A includes a block or extension 38 defining a surface 36 that engages end surface 34 of prong 32 of pawl lifter 22A when the mechanism 30 is in the configuration of FIG. 3. FIG. 3 shows a configuration in which the door is closed and latched, and the outside door handle is in a non-actuated or rest position.

If the outside door handle 7 is pulled open slowly in the direction of arrow B3 towards the position 7A, link 10A shifts in the direction of the arrow B (FIG. 4), and surface 36 of link 10A slides along surface 34 of prong 32 of pawl lifter 22A until the surfaces 36 and 34 disengage from one another, resulting in counterclockwise rotation of link 10A. Once the surfaces 34 and 36 disengage, the counterclockwise bias acting on link 10A initially causes link 10A to rotate, bringing surfaces 26 and 28 of link 10A and pawl lifter 22A, respectively, into contact with one another. As handle 7 and outside release lever 6A are further rotated, link 10A shifts longitudinally in the direction of the arrow B. Surfaces 18 and 20 of link 10A and pawl lifter 22A, respectively, then come into contact/engagement with each other. Further rotation of handle 7 and outside release lever 6A further shifts the link 10A in the direction of the arrow B, thereby rotating pawl lifter 22A in the direction of the arrow B2. Rotation of pawl lifter 22A releases the pawl 23 of the latch mechanism 25, thereby unlatching the latch mechanism 25 and permitting the vehicle door to open.

Figure 5:
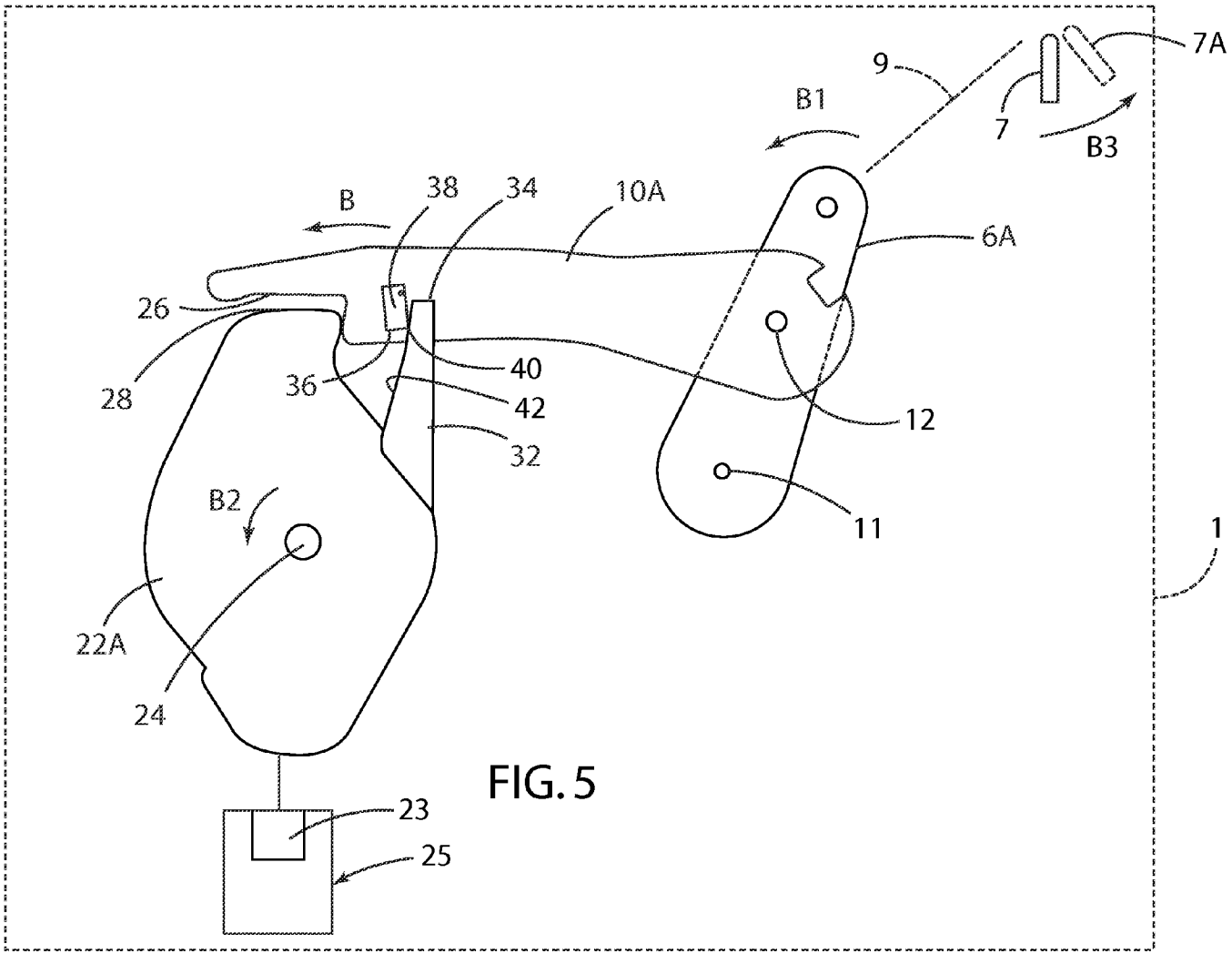
FIG. 5 is a partially schematic view of the latch device of FIG. 4 showing the link being reset to the configuration of FIG. 3 after release of a door handle.

With further reference to FIG. 5, a spring of a known type (not shown) biases lever 6A and handle 7 in directions opposite arrows B1 and B3, respectively. Thus, after a user releases the handle 7 the handle 7 rotates in a direction that is opposite arrow B3, and lever 6A rotates in the direction opposite the arrow B1. Rotation of lever 6A causes link 10A to shift in a direction opposite the arrow B. As the link 10A shifts in a direction opposite the arrow B, a corner surface 40 of block 38 of link 10A slides along surface 42 of prong 32 of pawl lifter 22A, and surfaces 26 and 28 of link 10A and pawl lifter 22A, respectively, disengage from one another. As the link 10A continues to shift in a direction opposite the arrow "B", the link 10A and pawl lifter 22A rotate in a clockwise direction, and return to the configuration shown in FIG. 3, thereby resetting the latch mechanism 30 to its initial or rest position.

Figure 6:
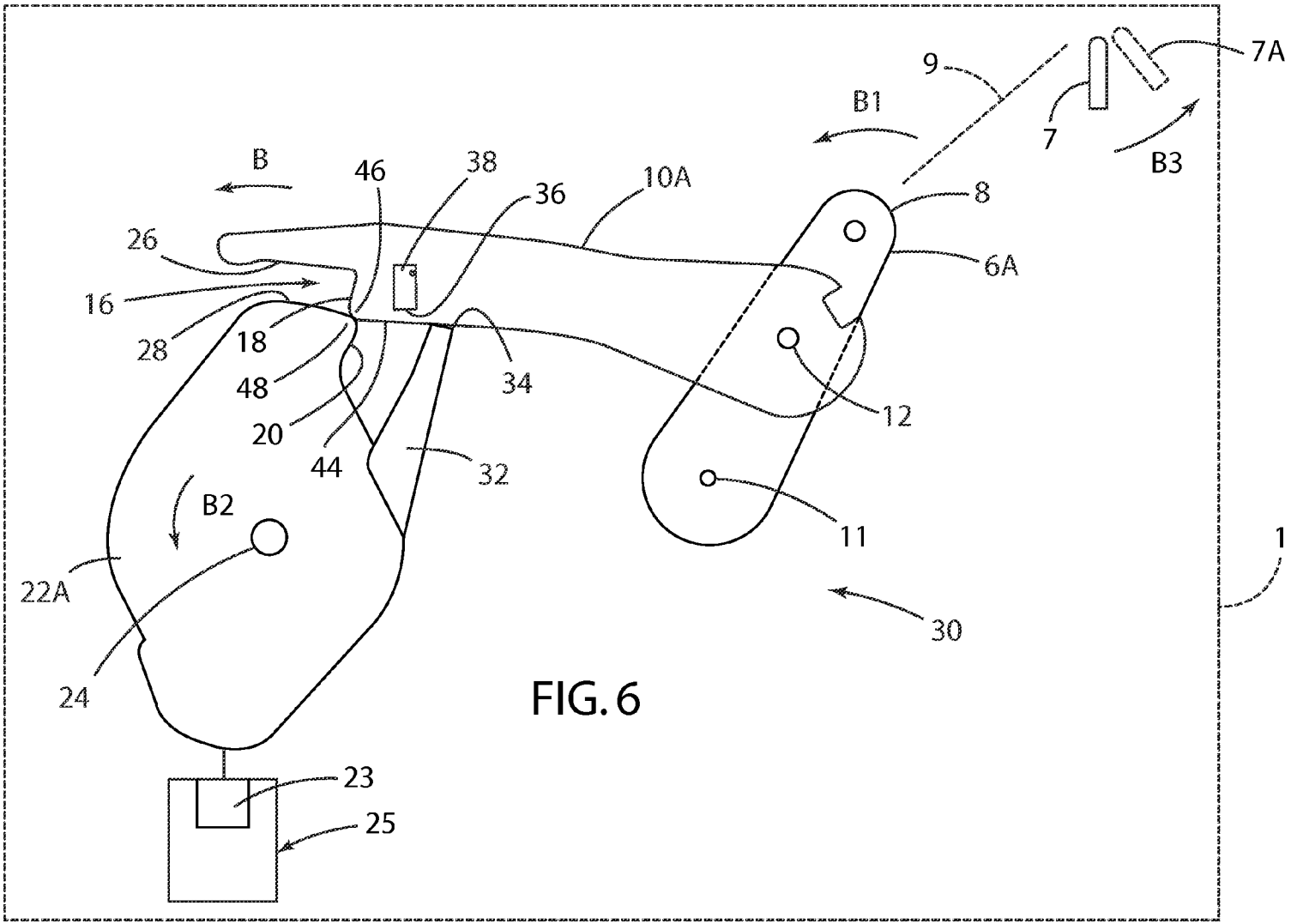
FIG. 6 is a partially schematic view of the linkage device showing the link shifted to a disengaged position due to relatively rapid opening of the door handle.

In the event the latch mechanism 30 is in the rest or initial position of FIG. 3, and if outside release lever 6A is rotated in the direction of the arrow B1 at a relatively high velocity, the link 10A will shift in the direction of the arrow B as shown in FIG. 6, and surface 44 of link 10A will slidably engage end surface 28 of pawl lifter 22A as shown in FIG. 6. High velocity rotation of release lever 6A causes outside corner 46 of link 10A to slide past outside corner 48 of pawl lifter 22A, resulting in sliding engagement between surface 44 of link 10A and end surface 28 of pawl lifter 22A. However, this sliding engagement does not generate sufficient force to rotate pawl lifter 22A in the direction of the arrow B2. As discussed above, link 10A is rotatably biased in a counterclockwise direction (FIG. 6). However, if the link 10A is shifted in the direction of the arrow B quickly enough, the link 10A will not rotate to the engaged position of FIG. 4, but rather will shift to the disengaged configuration of FIG. 6. Because push surface 18 of link 10A does not engage surface 20 of pawl lifter 22A when the latch mechanism 30 is in a configuration of FIG. 6, further rotation of outside release lever 6A due to outward movement of the vehicle door handle will not result in rotation of pawl lifter 22A. Pawl lifter 22A may be rotationally biased in a direction opposite arrow B2 to prevent movement of pawl lifter 22A due to sliding contact between surfaces 26 and 28 of link 10A and pawl lifter 22A, respectively.

It has been found that a user will typically move a door handle (e.g. handle 7) at 300 mm/s or less when opening a vehicle door. However, the handle 7 will typically move at 2500 mm/s or more in the event a vehicle is subject to a side impact event. Accordingly, in the illustrated example, the latch mechanism 30 is configured such that movement of the handle at 300 mm/s or less will result in the link 10A shifting to the engaged position of FIG. 4, thereby resulting in rotation of pawl lifter 22A and movement of the pawl to an unlatched position. However, if the outside handle is moved at 2500 mm/s or more, the outside corner 46 of link 10A slides past outside corner 48 pawl lifter 22A as shown in FIG. 6, such that pawl lifter 22A does not rotate, and the pawl of the door latch is not shifted to an unlatched position.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A vehicle door comprising:

a door structure;

an outside door handle movably mounted to the door structure;

an outside release member operably connected to the outside door handle such that movement of the outside door handle causes movement of the outside release member from a first position to an actuated position;

a latch mechanism mounted to the door structure;

a movable pawl lifter that unlatches the latch mechanism;

an intermediate link that selectively interconnects the outside release member to the movable pawl lifter when the intermediate link is in an engaged configuration, wherein the intermediate link is biased from a first disengaged configuration towards the engaged configuration, the intermediate link further defining a second disengaged configuration, the intermediate link including first, second, and third pawl-engaging surfaces;

the movable pawl lifter having first, second, and third link-engaging surfaces, wherein the first link-engaging surface engages the first pawl-engaging surface of the intermediate link when the intermediate link is in the engaged configuration to thereby cause movement of the movable pawl lifter from its locked position to its unlocked position upon movement of the outside release member from its first position to its actuated position;

wherein the second link-engaging surface of the movable pawl lifter engages the second pawl-engaging surface of the link to retain the link in the first disengaged configuration when the outside release member is in the first position;

wherein shifting of the outside release member from its first position to its actuated position at a first velocity disengages the second link-engaging surface from the second pawl-engaging surface and causes the link to shift to its engaged configuration wherein the first pawl-engaging surface of the link engages the first link-engaging surface of the pawl lifter and moves the movable pawl lifter from its locked position to its unlocked position, and wherein shifting of the outside release member from its first position to its actuated position at a second velocity that is significantly greater than the first velocity causes the link to shift from its first disengaged position and disengages the second pawl-engaging surface from the second link-engaging surface and subsequently causes the third pawl-engaging surface to engage the third link-engaging such that the link shifts to its second disengaged position without moving the movable pawl lifter to its unlocked position.

2. The vehicle door of claim 1, wherein:

the outside release member comprises an outside release lever that is pivotably mounted to the door structure.

3. The vehicle door of claim 2, wherein:

the intermediate link is pivotably connected to the outside release member.

4. The vehicle door of claim 3, wherein:

the movable pawl lifter is rotatably interconnected to the door structure.

5. The vehicle door of claim 4, wherein:

the pawl lifter includes an outside corner defined by an intersection of the first and third link-engaging surfaces; and the intermediate link comprises a fourth pawl-engaging surface that intersects the first pawl-engaging surface to define an inside corner that engages the outside corner of the pawl lifter with the first and third link-engaging surfaces in contact with the first and fourth pawl-engaging surfaces, respectively, when the intermediate link is in the engaged configuration.

6. The vehicle door of claim 5, wherein:

the intermediate link has a first end that is pivotably connected to the outside release member, and a second end comprising the inside corner.

7. The vehicle door of claim 6, wherein:

the intermediate link is rotatably biased such that the fourth pawl-engaging surface is biased into engagement with the third link-engaging surface.

8. The vehicle door of claim 1, wherein:

the movable pawl lifter includes a prong having an end forming the second link-engaging surface.

9. The vehicle door of claim 8, wherein:

the prong includes a cam surface that slidably engages the intermediate link as the intermediate link is moved from the engaged configuration back to the first disengaged configuration to thereby shift the movable pawl lifter from its unlocked position to its locked position to reset the latch mechanism.

10. The vehicle door of claim 9, wherein:

the first and second link-engaging surfaces of the movable pawl intersect to form an outside corner, and wherein the first link-engaging surface faces the cam surface of the prong.

* * * * *